United States Patent [19]

Boring

[11] Patent Number: 4,723,849

[45] Date of Patent: Feb. 9, 1988

[54] COMPOUNDING BLENDER FOR PLASTIC MATERIALS

[75] Inventor: Douglas J. Boring, Franklin, Pa.

[73] Assignee: Conair, Inc., Franklin, Pa.

[21] Appl. No.: 767,329

[22] Filed: Aug. 21, 1985

[51] Int. Cl.[4] ..... B01F 7/18

[52] U.S. Cl. ..... 366/285; 366/303; 366/328

[58] Field of Search ..... 366/194, 195, 196, 285, 366/303, 307, 325, 328, 329, 308, 311, 326

[56] References Cited

U.S. PATENT DOCUMENTS

| | | | |
|---|---|---|---|
| 2,073,779 | 3/1937 | Bramsen | 366/303 X |
| 2,609,185 | 9/1952 | Eisner | 366/285 X |
| 3,066,831 | 12/1962 | Thompson | 366/326 X |
| 3,245,663 | 4/1966 | Austin | 366/326 |
| 3,482,822 | 12/1969 | Krizak et al. | 366/303 X |
| 4,154,798 | 5/1979 | Bittner | 366/303 X |

OTHER PUBLICATIONS

"Engineering Data No. 108", by Conair, Inc., Franklin, Pa., Jun. 1983.

"Engineering Data No. 115", by Conair, Inc., Franklin, Pa., Jul. 1985.

*Primary Examiner*—Philip R. Coe

[57] ABSTRACT

A blending apparatus in which vertically spaced members are located below vertically spaced material sweep blades to prevent the materials which are being mixed from accumulating on the walls of the chamber in which the mixing occurs.

2 Claims, 3 Drawing Figures

COMPOUNDING BLENDER FOR PLASTIC MATERIALS

BACKGROUND OF THE INVENTION

In the plastics industry it is known to mix or blend a moldable base resin with various well-known materials or additives such as powders, fibrous materials, or pellets to provide a blend of material which has the proper proportion of additive and resin for a subsequent molding. The additives are for various purposes with respect to a molded article such as dry coloring powders for color purposes, filaments of fiberglass for strength purposes, powdered or pelletized additives for providing low cost fillers or for improved appearance or strength. All of such additives are well known and are commonly transported to a mixing chamber of a blender by being entrained in an air conveying system usually a vacuum system. Such mixing chambers are normally vertically extending members having a lower discharge opening in communication with the material inlet of a molding machine. Although such mixing chambers may be of any suitable configuration, such chambers are most frequently an inverted truncated conical member to permit a rotary mixing blade to rotate therein inwardly and uniformly adjacent the inner surface of the chamber.

In view of the various characteristics of the materials to be blended or mixed, prior blender chambers have utilized a series of circumferentially spaced break up bars which extend rigidly and vertically along the inner surface of the mixing chamber to prevent the materials being blended from becoming radially stratified. Prior break up bars of ⅛ inch thickness and ½ inch width spaced every 60 or 90 degrees have been commonly used. Such break up bars also prevent material from uninterrupted circulation around the inner periphery of the mixing chamber. Such break up bars are normally satisfactory for mixing molding additives and resins; however, there are various materials whereby break up bars do not provide uniform blending. In the instance of dry powders, and in particular dry color powders which frequently are quite fine, the fineness of the powder requires a low mixing blade speed, such as 150 rpm and lower, to prevent the powder from escaping as a dust. Under such conditions the dry powders will build up on the trailing surface or ledge of the break up bars, that is, the ⅛ inch dimension of the illustrative dimensions. Such build up of powders is erratic and inconsistent and at random times one or more of the accumulations of dry powder will break away from the break up bar or bars and enter the material being blended such that the blend will have a higher percentage of colorant with a resultant variation in product color. In many instances color consistency of a molded product is very important; however, in instances where consistent color is not essential, such as on molded plastic cutlery, color consistency will help sell the product. It will also be realized that as the dry color builds up the blend will be color starved which also produces a color variation in the molded products.

Another particular problem with such break up bars occurs with sticky additives—frequently fillers. Such sticky materials stick to the sidewall of the mixer between the break up bars until an agglomeration of the accumulated material breaks off from the sidewall and enters the blend material. Such sticky agglomerations can cause the mixer chamber discharge opening to become clogged or blocked or undesirable molded products. Obviously in a mixer with breaker bars the rotating mixer blade must clear the break up bars.

Prior blenders did not provide for any means below the mixing chamber; that is upwardly adjacent the inlet of the molding machine, for preventing hang-up or bridging of blended material in the discharge throat below the blender chamber. The present structure provides a pivoting blade which breaks up material in the discharge throat and facilitates the removal of the mixing chamber from the molding machine for cleaning purposes.

An illustration of a prior compounding blender is shown in Engineering Data No. 108 (copy attached) and Engineering data No. 115 distributed by Conair, Inc. of Franklin, Pa. The break up bars on the inner conical surface of the mixing or blending chamber are not shown in such publication.

BRIEF SUMMARY OF THE INVENTION

The invention of this application is to the same type of compounding blender as shown in the above-identified publication except that in place of break up bars on the inner surface of the chamber circumferentially spaced pins extend inwardly of the chamber at various vertically spaced levels of the chamber to prevent material accumulations on the inner surface of the chamber or along the trailing edge of the break up bars as previously described. Such pins are located at vertical levels within the chamber between vertically spaced portions of the mixer blade so that the pins can extend through a greater extent of the material being mixed than is possible with the previously described bars.

Accordingly, one object of this invention is to provide a new and improved material mixing device for mixing moldable plastic materials.

Another object of this invention is to provide the mixing chamber of a compounding blender with improved means to mix the material circulating within the chamber adjacent the inner surface thereof.

Another object of this invention is to provide a new and improved blender for plastic materials in which a series of vertically and circumferentially spaced members extend inwardly of the mixing chamber in areas through which a mixing blade does not pass.

Another object of this invention is to provide the mixing chamber of a compounding blender with means for mixing the material circulating within the chamber adjacent the inner surface thereof which are of a length determined independently of the extent of the path through which the mixer blade thereof travels.

A more specific object of this invention is to provide the mixing chamber of a compounding blender with circumferentially and vertically spaced pins which extend inwardly of the chamber to mix material circulating adjacent the inner surface of the chamber.

A further specific object of this invention is to provide the mixing chamber of a compounding blender with pins extending inwardly of the chamber in vertically spaced zones through which the mixing blade of the blender does not circulate.

A further object of this invention is to provide the rotating mixer blade structure of a plastic material blender with a lowermost axially outwardly extending mixing blade which is pivotable about a horizontal axis.

These and other objects of this invention will be better understood in view of the following description and illustrative drawings of a presently preferred embodiment of the invention in which.

Figure 1:
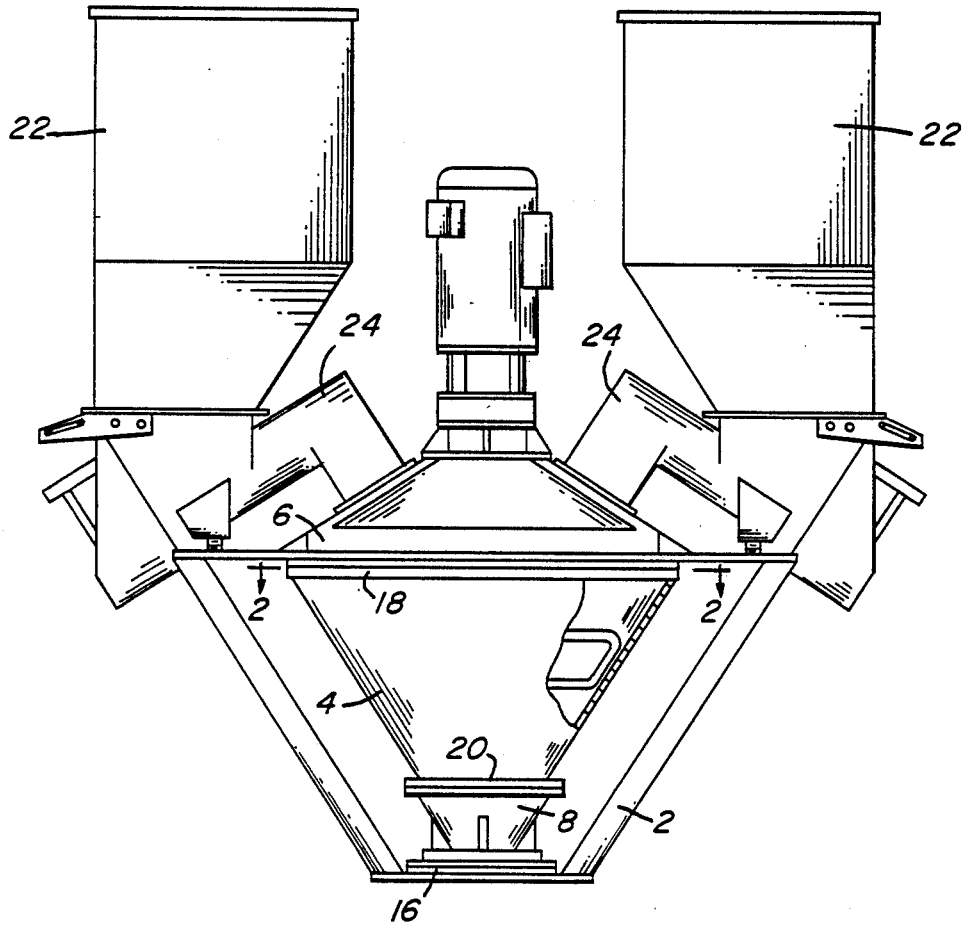
FIG. 1 is a side elevational view of a compounding blender as is known except for the structure of the mixing or blending chamber of this invention shown therein.
Figure 2:
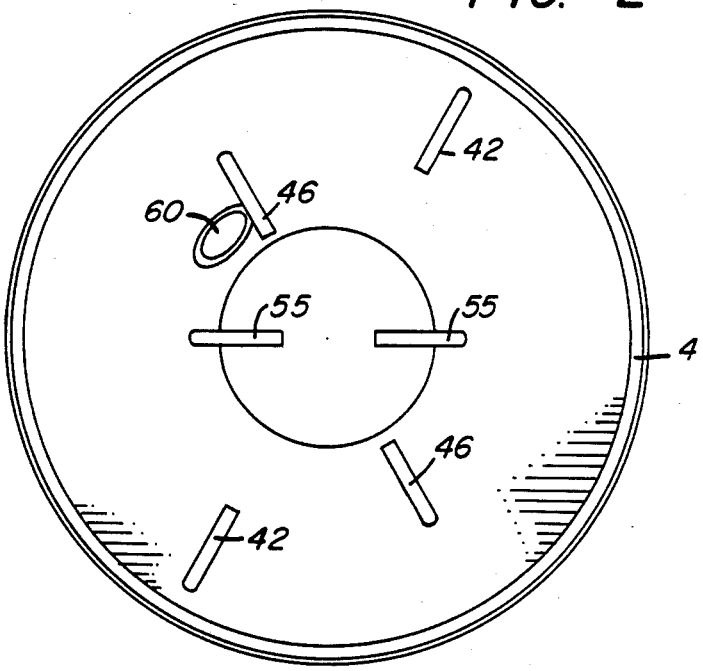
FIG. 2 is a top plan view of the mixing chamber of the blender shown in FIG. 1 taken along line 2—2.

As is known, a compounding blender comprises an open sided framework 2 which suitably supports a vertically extending mixing chamber 4 of the blender therewithin. Chamber 4 is located intermediate an upper closure member or head 6 and a lower throat member 8. Head 6 suitably stationarily supports a suitable drive motor 10 thereabove which drive motor 10 has a downwardly extending rotatable power output shaft 12 for selectively rotating a mixing blade 14 within the chamber 4. Motor 10 is of any suitable type and is preferably of an adjustable or variable speed to permit rotation of blade 14 at a desired rotational speed. The vertical central axes of shaft 12, throat 8 and chamber 4 are preferably coincident to provide for the best mixing of material within chamber 4. A suitable actuatable valve means 16 is provided at the lower end of throat 8 to control the gravitational discharge of blended or mixed material from chamber 4. The outer portion of valve means 16 is suitably rigidly secured to the lower portion of framework 2. Head 6 is suitably rigidly secured about its periphery above chamber 4 to the framework 2. Chamber 4 has an outwardly extending flange 18 at its upper end and an outwardly extending flange 20 at its lower end which underlie and overlie respective cooperable flanges on head 6 and throat 8. Such engaged flanges are selectively secured together or released by suitable releasable clasp means (not shown) as is well known to permit the chamber 4 to be removed as desired from between the head 6 and throat 8 and from within the framework 2. Framework 2 is of any suitable configuration to permit the removal of chamber 4 and to permit the attachment of framework 2 to a molding machine with the valve means 16 in vertical alignment with the material receiving opening of a molding machine.

In the illustrative embodiment a pair of vertically extending hoppers 22 are rigidly supported with respect to framework 2 with suitable material conveying means (not shown) supported at the upper end of hoppers 22 to supply separate materials to be blended to the hoppers 22 respectively. The lower ends of hoppers 22 are connected to suitable conveying means 24, such as augers, whereby a desired amount of materials are conveyed from hoppers 22 to the chamber 4 for mixing. Chamber 4 can be of any suitable configuration; however, as shown, an inverted truncated cone shape is preferred wherein the mixed materials are discharged through valve 16. With the two hoppers 22 as described it will be obvious that only two different materials can be blended in chamber 4. As is known and as is shown in Engineering Data No. 108 and 115, three or four hoppers 22 may be secured to framework 2 around motor 10 to permit three or four desired materials to be mixed. Inasmuch as the structure heretofore described is well known in the prior art, further description thereof is not necessary to one skilled in the relevant art for an understanding of this invention.

Figure 3:
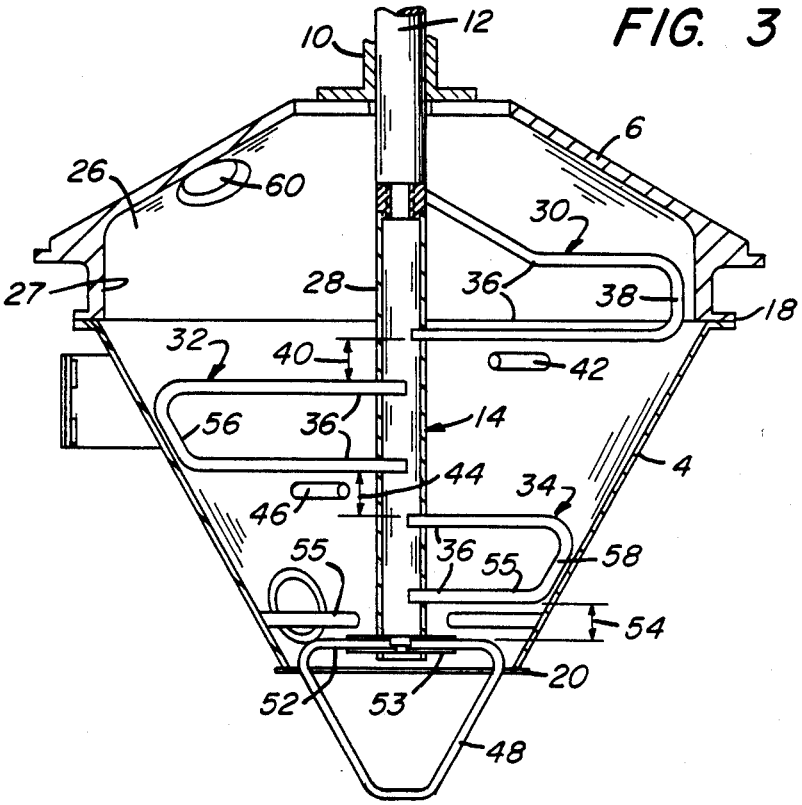
FIG. 3 is a cross-sectional view of the mixing chamber as shown in FIG. 1 with an upper closure member attached thereto.

As shown, head 6 has an internal upwardly extending dished portion 26 with the lowermost peripheral portion thereof being a vertically extending inner wall 27 with the lower end of shaft 12 passing centrally through portion 26. Shaft 12 is suitably removably secured to an elongated central shaft 28 of blade 14 with the lower end of shaft 28 being located upwardly adjacent the upper horizontally extending plane of the throat 8. Shaft 28 is of any suitable structure such as a tubular member to permit segments of blade 14 to be rigidly secured thereto. Blade 14 includes three formed vertically spaced segments, an upper segment 30, a lower segment 34 and a vertically intermediate segment 32. Segments 30, 32 and 34 are formed members with each segment being, in side elevation as shown in FIG. 3, a generally U-shaped member having horizontally extending vertically spaced arm portions 36 thereof suitably rigidly secured to rotor 28 such as by being welded thereto. When a welded connection is utilized segments 30, 32 and 34 and rotor 28 are of a suitable metal material to provide the necessary strength and to permit such weldment—for such purposes a $\frac{3}{8}$ inch diameter steel rod is satisfactory. Upper segment 30 has a radially outermost bight portion 38 extending vertically adjacent the inner wall 27 and downwardly into the chamber 4 with the lower arm 36 thereof extending horizontally and downwardly adjacent the horizontally extending juncture of head 6 and chamber 4.

The lower arm 36 of segment 30 is generally parallel to and vertically spaced from the upper arm 36 of segment 32 to provide an upper zone 40 within chamber 4 in which material is not traversed by either segment 30 or 32. A pair of diametrically extending pins 42 are suitably rigidly secured to chamber 4, such as by welding, to provide a pair of diametrically opposed pins 42 extending inwardly of chamber 4 from the inner surface thereof into zone 40. Similarly, the lower arm 36 of segment 32 is generally parallel to and vertically spaced above the upper arm 36 of segment 34 to provide an intermediate zone 44 within chamber 4 which is not traversed by either segment 32 or 34. A pair of diametrically extending pins 46 are suitably rigidly secured to chamber 4 to provide a pair of diametrically opposed pins 46 extending inwardly of the inner surface of chamber 4 within zone 44.

A formed lowermost mixing segment 48 is movably secured to the lower end of shaft 28 to provide for mixing material within throat 8. As shown, segment 48 is generally of an inverted triangular shape. The upper portion of segment 48 comprises a pair of uppermost opposed horizontally extending leg portions 52 each of which are suitably supported with respect to shaft 28 to pivot through a vertical arc about the central axis of shaft 28. As shown, the pivot support consists of having the leg portions 52 of circular cross section and interiorly received in tubular members 53 rigidly carried by shaft 28 and extending diametrically outwardly from shaft 28. Leg portions 52 are located upwardly adjacent the horizontally extending mating plane of the engaged flanges of chamber 4 and throat 8 and are vertically spaced below the lower arm 36 of segment 34. Leg portions 52 are essentially parallel to the lower arm 36 of segment 34 to provide in conjunction therewith a lowermost zone 54 within chamber 4 similar to zones 40, 44. Diametrically opposed and diametrically extending pins 55 are suitably rigidly secured to chamber 4 to extend inwardly of zone 54 from the inner surface of chamber 4. The downwardly converging sides of segment 48 are located closely adjacent and generally parallel to the inner surface of throat 8. With the downwardly converging sides of segment 48 throat 8 has an inverted truncated conical form. Similarly the bight portion 56 of segment 32 and the bight portion 58 of segment 34 extend closely adjacent the inner surface of chamber 4 and generally parallel thereto. With the structure of this invention the exterior of bight portions 56 and 58 can be located very close to the inner surface of chamber 4 such as ⅛ of an inch. Similarly, the outer surface of the sides of segment 48 can be located ⅛ of an inch from the inner surface of the throat 8.

With the above described structure different materials within chamber 4 can be better mixed to obtain the goal of a uniform and consistent blend of materials. Blade 14 is rotated at a selected rotational speed by controlling the energization of motor 10 for rotation at a desired r.p.m. as is known. Materials from conveyors 24 are gravitationally discharged through suitable openings 60 in head 6 respectively. Openings 60 are preferably located above the path of travel of the upper arm 38 of segment 30 so that the gravitationally descending material flow from openings 60 is swept by the upper arm 38 of segment 30. It is to be realized that the mixing of materials in chamber 4 will vary depending upon the amount of material in chamber 4. With an empty chamber 4 materials will drop quickly to the bottom of chamber 4 and the continuing supply of materials will cause the materials to build up within the chamber 4—i.e., the vertical height of materials within chamber 4 will increase until the chamber 4 receives a desired load. The vertical height of material in chamber 4 will decrease during material discharge. Thus, there will be various conditions as of mixing occurring within the chamber 4 under varying material conditions in chamber 4. Starting with chamber 4 being empty and valve means 16 closed, the initial mixing will occur while materials are being supplied to chamber 4 and while the amount of supplied materials is constantly increasing. Once chamber 4 is fully loaded no significant vertical flow of materials will occur within chamber 4; however, the segments 30, 32 and 34 will traverse the materials in chamber 4 above each of the zones 40, 44 and 54. With valve 16 being open, mixing will occur as the materials in chamber 4 decrease.

Regardless of what period of loading is occurring, segments 30, 32 and 34 will impart a rotary motion to the supplied materials about the vertically extending coincident central axes of shaft 28 and chamber 4 above zones 40, 44 and 54 respectively. During material discharge the portions of the circumferentially moving materials adjacent the inner surface of chamber 4 will gravitationally descend and encounter pins 42, 46 or 55. Due to the circumferential velocity of such materials, the materials will be impacted on pins 42, 46 and 55 to prevent such materials from agglomerating or accumulating on the inner surface of chamber 4. Pins 42, 46 and 55 are preferably of circular cross section, such as ⅜ inch steel rod, to minimize any trailing edge area upon which the circumferentially moving materials could accumulate.

There are various aspects of the structure of this invention which provide improved mixing or blending of materials. Since pins 42, 46 and 55 are located in zones through which the blade segments do not rotate, the bight portions 38, 56 and 58 can be located very close to the inner surface of chamber 4 as distinguished from the spacing required to clear the bars of the prior art by the rotating mixing blade. Since pins 42, 46 and 55 are located in zones 40, 44 and 54 through which segments 30, 32 and 34 do not pass the pins can be of any radial length as desired. The length of pins 42, 46 and 55 normally varies in radial extent due to the interior conic surface of chamber 4; however, with this invention the pins 42, 46 and 55 may be of any length as desired and need not be of any uniform length within a specific zone. As many circumferentially spaced pins as desired can be utilized and the circumferential location of the pins can be varied as desired. Pins 42, 46 and 55 can be made of a structure to permit the pins to be inserted into or retracted from the interior of chamber 4 whereby the number of pins can be varied as desired. Also the pins can be vertically offset within a zone 40, 44 and 54 as desired. If desired, pins 42, 46 and 55 can be provided with a rotating outer surface portion to further prevent any build up of materials thereon.

In the presently preferred embodiment shown the upper pins 42 are circumferentially offset 60 degrees in the same circumferential direction from pins 46 and pins 46 are circumferentially offset 60 degrees from pins 55 in the same circumferential direction as pins 46 were offset from pins 42 so that a pin is located at every 60 degrees along the circumference of chamber 4 although in different vertical zones. As shown, segments 30 and 34 extend in one radial direction while the intermediate segment extends in the opposite radial direction. With the structure of this invention as many segments 30, 32 and 34 can be provided as desired and can be circumferentially offset as desired such as in the manner the pins are offset as previously described.

Segment 48 provides a certain degree of final mixing of materials in the throat 8; however, in view of the improved mixing within chamber 4 the mixing within throat 8 is not of primary significance. Segment 48 does prevent bridging of mixed material in or upwardly adjacent the throat 8. Bridging of material above the discharge opening is well known and the elimination of such bridging provides for supplying mixed material to a molding machine at a more uniform rate. Another feature of segment 48 is that it pivots vertically or swings out of the way to permit the easy insertion or removable of chamber 4 between throat 8 and head 6.

It is also to be noted that the structure of this invention provides a plurality of vertically spaced mixing zones in which mixing occurs by rotating means with zones for preventing accumulation of materials on the inner surface of the mixing chamber therebetween. Although a blade segment does not rotate through zones 40, 46 and 54 mixing does occur therein due to the respective pins therein and due to the mixing that occurs within a gravitationally flowing mixture of materials. Thus chamber 4 performs a mixing action throughout its vertical height; however, its height consists of vertically spaced agitated mixing zones with zones having outer circumferential material flow break up means therebetween. Such alternating of zones insures that there is a frequent change of mixing action to obtain essentially uniform mixing of dry particles of materials.

Having described a presently preferred embodiment of this invention in accordance with the Patent Statutes, those skilled in the relevant art will be cognizant of the fact that modifications can be made to the described structure without departing from the spirit and scope of this invention. Accordingly, the following claims are to be construed as including modifications of the structures defined herein as would be known to those skilled in the relevant art.

I claim:

1. A mixing device comprising, an upstanding chamber, means cooperable with the upper portion of said chamber for supplying selected quantities of dry flowable materials to said chamber, respectively, throat means cooperable with the lower porion of said chamber for permitting discharge of material from said chamber, an elongated blade structure rotatable about a vertically extending axis within said chamber, said blade structure having segments spaced vertically along said axis which segments extend transversely of said axis and have their outer end located closely adjacent the inner surface of said chamber, said chamber having at least one means extending from the inner surface thereof towards said axis and between at least one vertically spaced pair of said segments, said blade structure having a lowermost segment connected thereto to pivot through a vertical arc with respect to said axis, and said lowermost segment has outer portions located closely adjacent the inner surface of said throat means.

2. A mixing device as set forth in claim 1 wherein said lowermost segment has an elongated portion located within $\frac{1}{8}$ of an inch of the inner surface of said throat means.

* * * * *